US010004367B2

(12) United States Patent
Brown et al.

(10) Patent No.: US 10,004,367 B2
(45) Date of Patent: Jun. 26, 2018

(54) BODY DRYING SYSTEM

(71) Applicants: Jeffry Brown, Roanoke, IN (US); Max W. Garwood, Huntington, IN (US)

(72) Inventors: Jeffry Brown, Roanoke, IN (US); Max W. Garwood, Huntington, IN (US)

( * ) Notice: Subject to any disclaimer, the term of this patent is extended or adjusted under 35 U.S.C. 154(b) by 309 days.

(21) Appl. No.: 14/711,168

(22) Filed: May 13, 2015

(65) Prior Publication Data

US 2016/0331193 A1 Nov. 17, 2016

(51) Int. Cl.

| | |
|---|---|
| ***A47K 10/48*** | (2006.01) |
| ***A45D 20/16*** | (2006.01) |
| *A45D 20/12* | (2006.01) |
| *A45D 20/06* | (2006.01) |

(52) U.S. Cl.

CPC ..... *A47K 10/48* (2013.01); *A45D 20/16* (2013.01); *A47K 10/485* (2013.01); *A45D 2020/065* (2013.01); *A45D 2020/126* (2013.01); *A45D 2020/128* (2013.01)

(58) Field of Classification Search

CPC ..... A47K 10/48; A47K 10/485; A45D 20/00; A45D 20/04; A45D 20/20; A45D 20/22; A45D 20/08; A45D 20/10; A45D 20/14; A45D 20/16; A45D 2020/126; A45D 2020/065; A45D 2020/128

USPC ..... 34/283, 90, 96, 97, 98

See application file for complete search history.

(56) References Cited

U.S. PATENT DOCUMENTS 3,104,014 A * 9/1963 Piette ..... A47H 1/02 160/124
3,878,621 A * 4/1975 Duerre ..... A45D 20/16 34/233
4,642,909 A * 2/1987 Garcia ..... A45D 20/16 239/282
4,858,336 A * 8/1989 Varma ..... A45D 20/16 312/227
4,871,900 A * 10/1989 Hickman ..... F26B 9/006 34/202
4,937,432 A * 6/1990 Bertani ..... A47K 10/48 200/52 R
5,339,469 A * 8/1994 Gilles ..... B05B 1/1636 15/205.2
6,351,894 B1 * 3/2002 Lund ..... A47L 23/205 34/106
6,446,278 B1 * 9/2002 Lin ..... E03C 1/06 4/615
9,173,809 B2 * 11/2015 Honeyands ..... A61H 33/028
2002/0007510 A1 * 1/2002 Mann ..... E03C 1/057 4/300
2008/0271238 A1 * 11/2008 Reeder ..... A46B 7/04 4/597

(Continued)

FOREIGN PATENT DOCUMENTS

WO WO 2015152828 A1 * 10/2015 ..... A45D 20/08

OTHER PUBLICATIONS

WO2015152828, retrieved on Mar. 23, 2017.*

*Primary Examiner* — Raymond L. Williamson

(57) ABSTRACT

A body drying system for use in a shower including a power unit configured to supply heated air, an airflow transitional part configured to be supported by part of a shower closure, and a hand-held air delivery nozzle. The hand-held air delivery nozzle is fluidly coupled to the power unit by way of the airflow transitional part. The hand-held air delivery nozzle is configured to expel the heated air.

18 Claims, 4 Drawing Sheets

(56) References Cited

U.S. PATENT DOCUMENTS

| | | | | |
|---|---|---|---|---|
| 2012/0042536 | A1* | 2/2012 | White | A47K 10/48<br>34/486 |
| 2016/0045084 | A1* | 2/2016 | Shabazz | A45D 20/08<br>392/380 |

* cited by examiner

BODY DRYING SYSTEM

BACKGROUND OF THE INVENTION

1. Field of the Invention

The present invention relates to a body dryer, and, more particularly, to a body dryer for use in a shower.

2. Description of the Related Art

A shower is a place in which a person bathes under a spray of, typically warm water. Showers may have adjustable temperature, spray pressure and showerhead nozzle settings. The simplest showers have a swiveling nozzle generally aimed down on the user. More complex showers have a showerhead connected to a hose, which has a mounting bracket, and allows the user to spray the water at different parts of their body. A shower can be installed in a shower stall or be associated with a bathtub.

Showering is common in western cultures generally due to the efficiency of using it when compared to a bath. A shower typically uses less water on average than a bath with 80 liters used for a shower as compared to 150 liters for a bath.

After a shower the process of drying off is typically accomplished using a towel. However the drying off experience can be a difficult and strenuous for those who are physically challenged. If the arms or hands are disabled, even a task as simple as drying the body after a shower can be very challenging and embarrassing, since many times, a caregiver much provide help.

Body dryers work somewhat on the same principal as hand dryers found in many public restrooms. However, the air dryers in public restrooms are only used for drying the hands and a full body dryer system can dry the whole body in minutes while a person remains in the handicap shower stall or bath area. The systems typically work by releasing warm air into the area, and drying the body by enhanced evaporation.

Even though body dryers are especially helpful to the handicapped, it is also a feature that can be useful in traditional bathrooms. There are different types of body dryer systems and each has it's own installation instructions. Some are made to mount outside the shower area, which can be an inconvenience to users by having to move from one area to the other while still wet from bathing. These may also make it necessary for the disabled to require a certain amount of help, depending on mobility issues. These types generally blow warm air in one direction and make it difficult to dry easily all over without turning or moving.

Another type is exemplified as the "Tornado Gentle Air Body Dryer" which is designed to be mounted directly inside the shower or near the handicap bathtub area. It has a body length air tube that may be installed in a corner of the shower to distribute air around the body to dry a person before exiting the shower or bath area. When the unit has been turned on, a person must stand or sit in the shower for drying.

Issues with body dryers installed in the shower are the need for installation and the need to ensure that the electrical wiring is properly done. Another issue is how the unit is activated to ensure that there is not a shock hazard Other body dryers are configured to be used after a person leaves the shower. One type is typically installed on the wall having a hose that is used by the person to direct the heated air. Another type is one on which a person stands and the air is blown upward and around the body. Each of these take place after a person leaves the shower and may be a chilling experience at least until the drying unit can provide enough heat to offset any chill in the room.

What is needed in the art is a. body dryer that can be used in the shower, and is controlled by electrical systems separated from the shower enclosure.

SUMMARY OF THE INVENTION

The present invention provides a body dryer having a hand-held portion configured for use in a shower.

The invention in one form is directed to a body drying system for use in a shower including a power unit configured to supply heated air, an airflow transitional part configured to be supported by part of a shower closure, and a hand-held air delivery nozzle. The hand-held air delivery nozzle is fluidly coupled to the power unit by way of the airflow transitional part. The hand-held air delivery nozzle is configured to expel the heated air.

The invention in another form is directed to a method of drying off while in a shower, including the steps of: supplying heated air from a power unit; supporting an airflow transitional part upon a part of a shower closure; and delivering the heated air to a person in the shower from a hand-held air delivery nozzle fluidly coupled to the power unit by way of the airflow transitional part.

An advantage of the present invention is that the drying air can be directed by the user while in the shower.

Another advantage is that the non-electrical controls can be used in the shower to activate and deactivate the unit.

Yet another advantage is that the unit is easily moved since nothing is attached to the shower.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention, in one form, and such exemplification is not to be construed as limiting the scope of the invention in any manner.

DETAILED DESCRIPTION OF THE INVENTION

Figure 1:
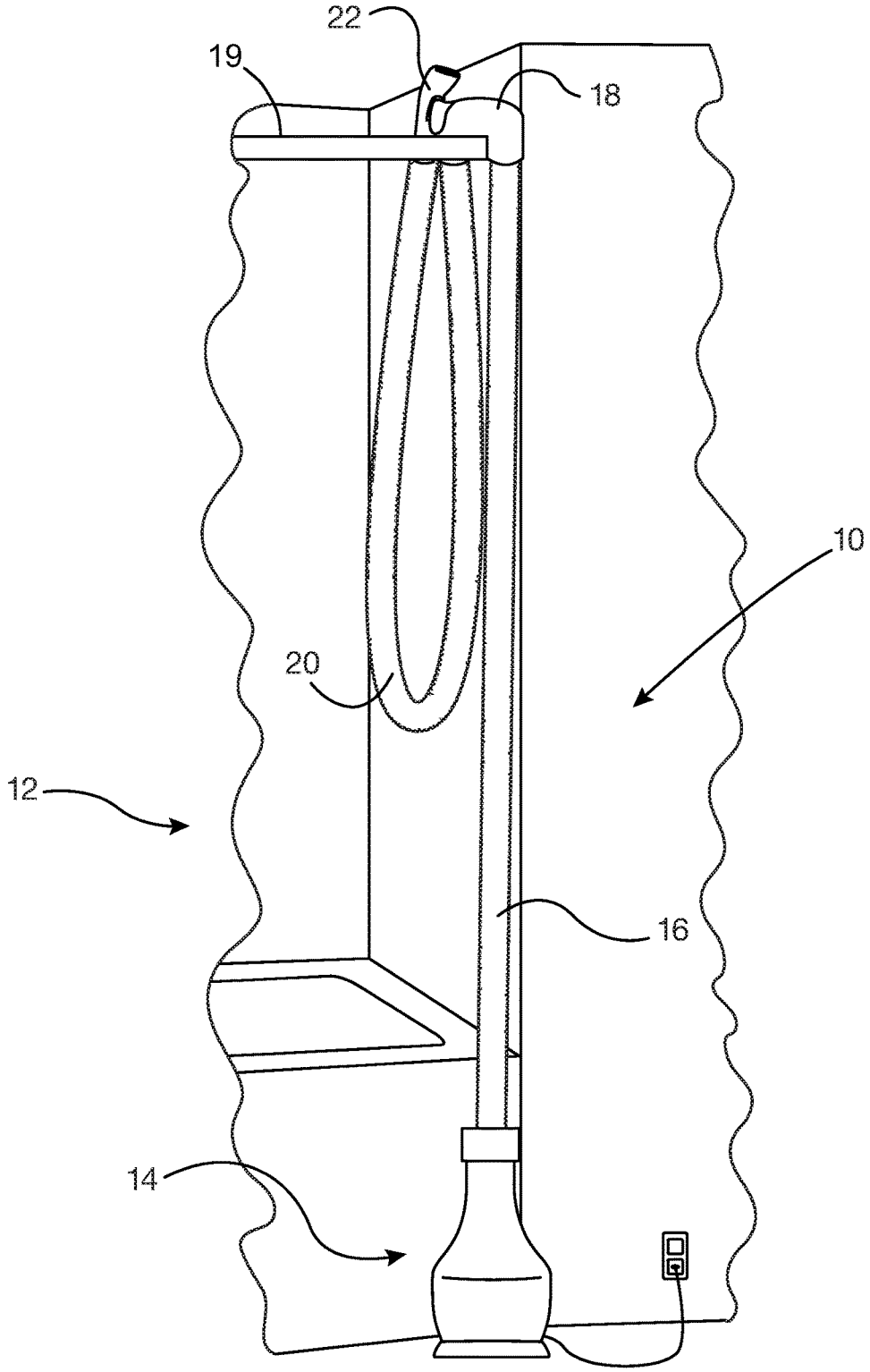
FIG. 1 is a perspective view of a tub/shower with an embodiment of a body dryer of the present invention partially draped of a shower curtain rod.

Referring now to the drawings, and more particularly to FIG. 1, there is shown an embodiment of a body drying system 10 for use in a shower 12. The word "shower" is meant to broadly include what is traditionally referred to as a shower/tub arrangement as well as a stand-alone shower.

Body drying system 10 including a power unit 14, a hose 16, an airflow transitional part 18, a hose 20 and a hand-held nozzle 22. Power unit 14 has a heating element and a fan that are electrically powered and may be electrically connected to a household electrical outlet. Hose 16 couples power unit 14 and airflow transitional part 18 so that warmed air can flow therethrough.

Figure 2:
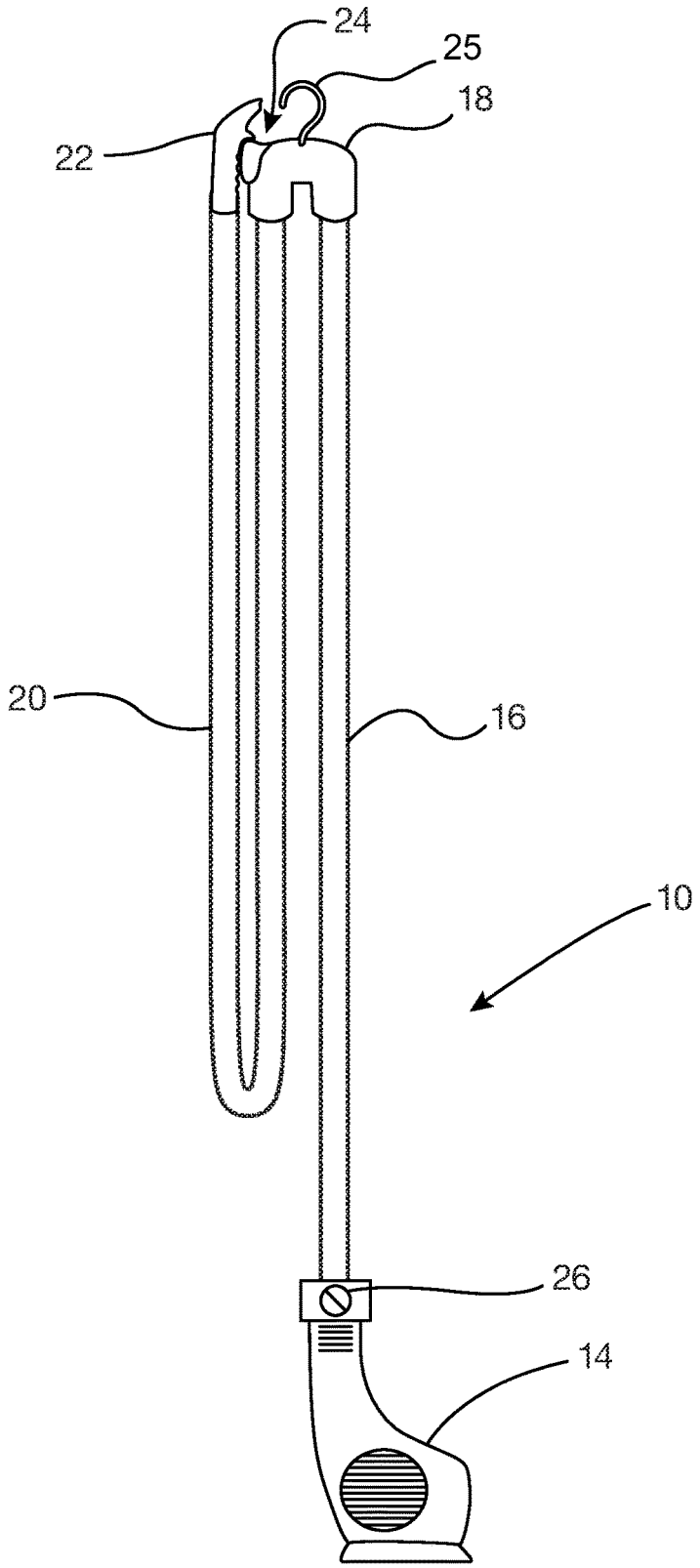
FIG. 2 is a plan view of the body dryer of FIG. 1.

Now, additionally referring to FIG. 2, airflow transitional part 18 serves several functions, among them the transfer of warmed air from hose 16 to hose 20. Airflow transitional part 18 includes a sensor system 24 that allows for one of the ways in which body drying system 10 can be activated and deactivated. Airflow transitional part 18 additionally is shaped so as to be set across, or straddle (as seen in FIG. 1) a shower closure 19, such as a doorframe 19, as shown in FIG. 1, or to be hung by an integral hook arrangement 25, which is illustrated in FIG. 2. The hook 25 may be used when a shower rod 19 and curtain is part of shower 12.

Figure 3:
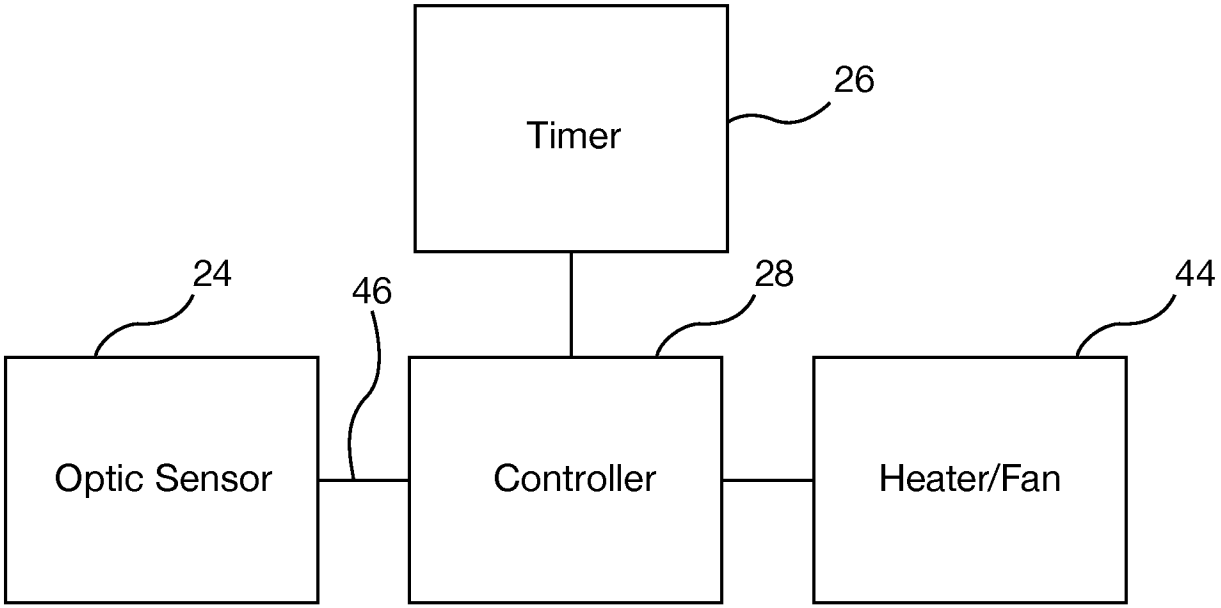
FIG. 3 is a schematical representation of the systems of the body dryer of FIGS. 1 and 2.

Now, additionally referring to FIG. 3, power unit 14 may additionally be controlled by way of a timer 26 and generically a controller 28. Controller 28 can control heater 44 and receives a signal from sensor 24 by way of a fiber optic circuit 46. Timer 26 has a turn on and off function. For example, timer 26 and controller 28 can be set by the user to allow a delayed start and then a subsequent stop of power unit 14. This may be embodied by the user setting timer 26 for a selected time, for example, to a three minute delayed start. The user then enters shower 12 and takes a shower, after three minutes have passed power unit 14 starts, thereby reminding the user to turn off the shower and dry off using hand-held nozzle 22. After a predetermined time period, which may be fixed or programmed into controller 28, power unit 14 deactivates. This arrangement has the advantages in that it times the shower experience, particularly for those in water shortage areas, and hurries those along that want to enjoy the warmed air from body dryer 10.

Figure 5:
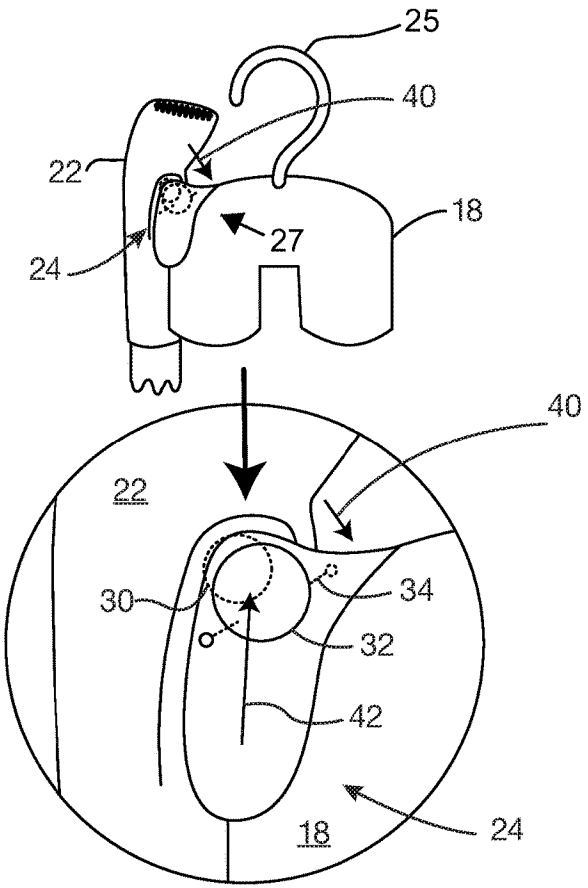
FIG. 5 is another view of the interface between the hand-held air delivery nozzle and the hanger portion of the body dryer of FIGS. 1 and 2
Figure 4:
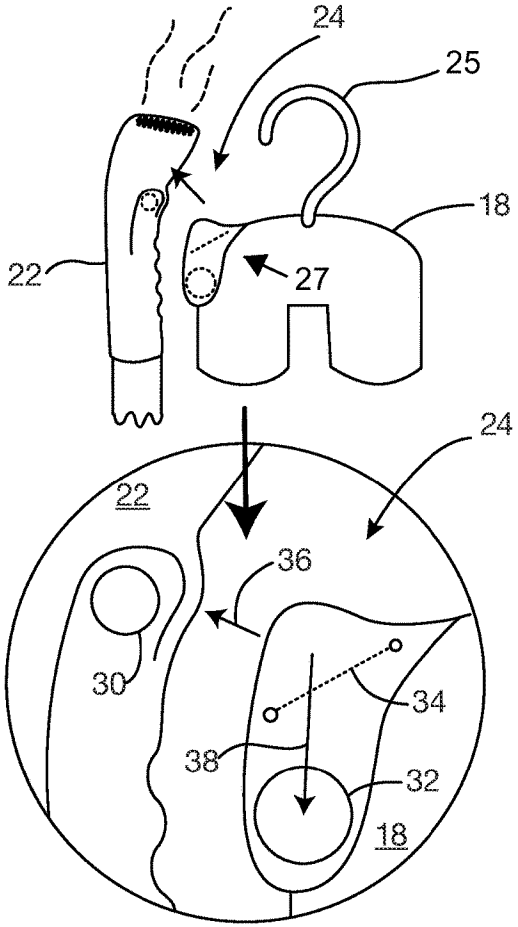
FIG. 4 is a view with a close up of an interface of the air delivery nozzle with a hanger portion of the body dryer of FIGS. 1 and 2.

Now, additionally referring to FIGS. 4 and 5, hand-held nozzle 22 is shaped to deliver the warmed air in an accelerated manner so that the combination of warmed air and the velocity of the air removes water from the skin and hair. Hand-held nozzle 22 includes a magnetically influenced part 30, fixed therein, that interacts with a magnetically influenced part 32 in airflow transitional part 18, the interaction thereof having a dual purpose. Magnetically influenced parts 30 and 32 may consist of one of them being a magnet and the other being a ferrous item, or both of them may be magnets. For the ease of discussion hereafter they will be referred to as magnets 30 and 32. The first purpose of magnets 30 and 32 are to help secure hand-held nozzle 22 to airflow transitional part 18 by way of the respective magnetic attraction. This purpose may work in coordination with an otherwise mechanical coupling or interaction between hand-held nozzle 22 and airflow transitional part 18. The second purpose of magnets 30 and 32 are that magnet 32 is free to move to some extent in airflow transitional part 18, with the movement being detected by sensor 24. As hand-held nozzle 22 approaches a nesting arrangement 27 with airflow transitional part 18, then magnet 30 causes magnet 32 to move, which can interrupt an optical path 34, and magnets 30 and 32 interact to help hold hand-held nozzle 22 in the nested arrangement 27 with airflow transitional part 18.

Hose 18 has attached to it, or imbedded within it fiber optic circuit 46 that conveys an optical signal from sensor 24 to controller 28. The sense of sensor 24 illustrated herein involves the braking of optical pathway 34, but it is also contemplated that other sensor senses and types may be used, such as Hall sensors. In the best embodiment the inclusion of an entirely optical sensor 24 and fiber optics 46 eliminates an electrical circuit that is not needed close to shower 12. The signal generated by the interaction of magnets 30 and 32 along with the interruption or completion of optical pathway 34 allows controller 28 to then turn on heater/fan 44 to start and stop the flow of warmed air to hand-held nozzle 22.

It is also contemplated that timer 26 may emit a sound rather than turning on/off power unit 14 to alert the user of the passage of time and the entire activation of power unit 14 may take place by the location of hand-held nozzle 22. As hand-held nozzle 22 moves in a disengaging direction 36 magnet 32 moves in a direction 38 allowing light to travel along optical pathway 34, which sends a signal down fiber optic circuit 46 to controller 28 to thereby turn power unit 14 on for the delivery of warmed air to hand-held nozzle 22. Conversely, when hand held nozzle 22 is moved in an engaging or nesting direction 40 then the attraction between magnets 30 and 32 cause magnet 32 to move in direction 42 causing an interruption in optical pathway 34 and the information of this event is sent to controller 28 by way of fiber optic circuit 46, which turns off power unit 14.

The present invention eliminates the need for towels, thereby saving money on the cost of them and the continual use of resources in keeping the towels clean. The present invention also is usable in the shower, without the need for leaving the enclosure to dry off. Also, the present invention introduces warmed air into the shower enclosure resulting in a quick dissipation of the humidity that might otherwise cause issues in the enclosure. Yet further, the present invention allows the user to direct the flow of air as desired to effectively dry the skin and hair.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A body drying system for use in a shower, comprising:

a power unit configured to supply heated air;

an airflow transitional part supported by a portion of a shower closure, said airflow transitional part being shaped like an upside down U; and a hand-held air delivery nozzle fluidly coupled to said power unit by way of said airflow transitional part through which the heated air flows to said hand-held air delivery nozzle, said hand-held air delivery nozzle expelling the heated air, the hand-held air delivery nozzle having a nestable arrangement with the airflow transitional part; a first hose coupled to said power unit and to said airflow transitional part; and a second hose coupled to said airflow transitional part and to said hand-held air delivery nozzle, the first hose and the second hose being suspended from the airflow transitional part.

2. The body drying system of claim 1, wherein said airflow transitional part straddles the shower closure.

3. The body drying system of claim 1, wherein said airflow transitional part has a hook extending therefrom that is hookable to the shower closure, the shower closure being a shower rod.

4. The body drying system of claim 1, further comprising a control system controllingly coupled to said power unit, said control system being configured to start and stop said power unit.

5. The body drying system of claim 4, wherein said control system includes a timer, said timer being configured to signal the control system to at least one of start said power unit and stop said power unit.

6. The body drying system of claim 5, wherein said timer is configured to signal the control system to both start said power unit and to stop said power unit.

7. The body drying system of claim 4, further comprising:

a sensor coupled to said airflow transitional part, said sensor being configured to detect the nestable arrangement of said hand-held air delivery nozzle with said airflow transitional part, said sensor being configured to send a signal to said control system to stop and start said power unit.

8. The body drying system of claim 7, further comprising a fiber optic circuit extending with said first hose from said power unit to said airflow transitional part, said fiber optic circuit being coupled with said sensor for conveying said signal to said control system.

9. The body drying system of claim 8, further comprising a magnetic coupling arrangement having:

a first magnetically influenced part fixed in said hand-held air delivery nozzle; and a second magnetically influenced part moveably constrained in said airflow transitional part, at least one of said first magnetically influenced part and said second magnetically influenced part being a magnet, said magnetic coupling arrangement being configured to nest said hand-held air delivery nozzle with said airflow transitional part.

10. The body drying system of claim 9, wherein said second magnetically influenced part moves to one of allow and block an optical pathway of said sensor as said first magnetically influenced part is one of proximate to and apart from said second magnetically influenced part.

11. A method of drying off while in a shower, comprising the steps of:

detecting a movement of a hand-held air delivery nozzle in a disengaging direction from an airflow transitional part;

activating a power unit to supply heated air through the airflow transitional part dependent upon detecting the movement of the hand-held air delivery nozzle;

supporting the airflow transitional part upon a portion of a shower closure, said airflow transitional part being shaped like an upside down U; and delivering the heated air to a person in the shower from the hand-held air delivery nozzle fluidly coupled to said power unit by way of said airflow transitional part through which the heated air travels; coupling a first hose to said power unit and to said airflow transitional part; and coupling a second hose to said airflow transitional part and to said hand-held air delivery nozzle, the first hose and the second hose hanging from the airflow transitional part.

12. The method of claim 11, wherein said airflow transitional part sets on the shower closure.

13. The method of claim 11, wherein said airflow transitional part has a hook extending therefrom that is configured to be hooked upon the shower closure.

14. The method of claim 11, further comprising the step of controlling said power unit with a control system that is configured to start and stop said power unit.

15. The method of claim 14, wherein said control system includes a timer, said timer being configured to signal the control system to at least one of start said power unit and stop said power unit.

16. The method of claim 15, wherein said timer is configured to signal the control system to both start said power unit and to stop said power unit.

17. The method of claim 14, further comprising a sensor coupled to said airflow transitional part, said sensor being used to carry out the detecting step, said sensor being configured to send a signal to said control system to stop and start said power unit.

18. The method of claim 17, further comprising a fiber optic circuit extending with said first hose from said power unit to said airflow transitional part, said fiber optic circuit being coupled with said sensor for conveying said signal to said control system.

* * * * *